US006196491B1

(12) United States Patent
Kross et al.

(10) Patent No.: US 6,196,491 B1
(45) Date of Patent: Mar. 6, 2001

(54) METHOD AND DEVICE FOR WINDING YARN ONTO A CONICAL SPOOL BODY

(75) Inventors: Stefan Kross; Paul Schroers, both of Viersen; Hans Raasch, Mönchengladbach; Guido Spix, Kaarst, all of (DE)

(73) Assignee: Volkmann GmbH & Co. (DE)

( * ) Notice: Subject to any disclaimer, the term of this patent is extended or adjusted under 35 U.S.C. 154(b) by 0 days.

(21) Appl. No.: 09/249,688

(22) Filed: Feb. 12, 1999

(30) Foreign Application Priority Data

Feb. 14, 1998 (EP) ..... 98102591

(51) Int. Cl.[7] ..... B65H 54/36

(52) U.S. Cl. ..... 242/477.3; 242/481.4; 242/486.8; 242/486.3

(58) Field of Search ..... 242/486.3, 478.2, 242/480.4, 486.7, 486.8, 477.3, 481.4

(56) References Cited

U.S. PATENT DOCUMENTS 1,135,090 * 4/1915 Allen ..... 242/477.3
3,945,579 * 3/1976 Schippers et al. .
4,019,691 * 4/1977 Wroclawski et al. ..... 242/486.3
4,089,480 * 5/1978 Kamp .
4,515,320 * 5/1985 Slavik et al. ..... 242/486.3 X
4,789,107 * 12/1988 Hauser et al. .
4,988,048 * 1/1991 Lochbronner ..... 242/486.7 X
5,035,369 * 7/1991 Beran et al. .
5,639,037 * 6/1997 Marangone et al. ..... 242/478.2 X

FOREIGN PATENT DOCUMENTS 2 328 993 * 8/1974 (DE) .
24 58 853 6/1976 (DE) .

* cited by examiner

*Primary Examiner*—Donald P. Walsh
*Assistant Examiner*—Collin A. Webb
(74) *Attorney, Agent, or Firm*—Robert W. Becker & Associates

(57) ABSTRACT

In a method for winding a yarn onto a spool body, the conical spool body is driven about a longitudinal axis by a first drive unit. A yarn is guided onto the spool body by a reciprocating yarn guide thereby winding the yarn onto the spool body. A constant yarn winding speed is provided along the length of the spool body during the entire yarn winding process by adjusting the revolutions per minute of the spool body synchronously with a movement of the reciprocating yarn guide. The revolutions per minute are controlled by a computing and control unit based on the instant position of the reciprocating yarn guide and the diameter of the spool body at the instant position. The device for performing this method has a sensor for detecting the changing diameter of the spool body, and the reciprocating yarn guide has a detection device for detecting the instant position of the reciprocating yarn guide.

11 Claims, 4 Drawing Sheets

METHOD AND DEVICE FOR WINDING YARN ONTO A CONICAL SPOOL BODY

BACKGROUND OF THE INVENTION

The present invention relates to a method and a device for winding yarn onto a conical or frusto-conical spool body driven about its longitudinal axis onto which the yarn is placed by a reciprocating yarn guide, whereby the revolutions per minute of the spool body is synchronously changed with the movement, respectively, the respective instant placement position of the reciprocating yarn guide and as a function of the diameter of the spool body in order to affect across the length of the spool body and also during the entire winding process a substantially constant yarn winding speed onto the spool body.

Winding of yarn onto a conical spool body is a problem when it is desired to supply or remove the yarn with a constant speed. Independent of the drive action of the spool body by a friction roller or a direct driving action of the spool body, for a constant rpm of the axle of the spool within one layer of yarn, less yarn is wound onto the side with the smaller spool diameter than onto the side with the greater spool diameter. Especially when driving the spool body by a friction roller, that drives the spool body conventionally at an ideal spot-like drive position realized by a spherically embodied friction roller coating, a constant rpm of the axle of the spool body will result. Without any additional features or devices, it is therefore impossible to attain a constant winding speed for all possible placement positions.

For winding devices driven by friction rollers, in which the yarn is supplied with a constant feed speed, it is known to store length of yarn in mechanical yarn storage devices, for example, pitching or take up levers. During the movement of the yarn guide from the side with the greater spool diameter to the side with the smaller diameter, yarn is introduced into the yarn storage device and is then released upon return movement. The control of such yarn storage devices is synchronized to the placement position such that the overlap of the movement laws of the spool body and the yarn storage device provide for a constant feed speed. Due to the different winding speeds at the smaller and the greater spool diameter, high yarn tensioning peaks would result without such yarn storage devices and would cause stretching or compression within the yarn and thus would increase the yarn breakage rate. With conventional conical spool designs, the yarn tension peaks are so high that, in practice, it is impossible to eliminate such storage devices.

For winding devices driven by friction rollers and with which yarn is removed, it is possible, in principle, to do away with such storage devices. Since, however, a constant removal speed cannot be achieved, the quality parameters of the yarn will change, for example, in twisting machines the twist along the placement direction. This is also undesirable.

In a winding device disclosed in German Offenlegungsschrift 24 58 853, the rpm of the spool body is synchronously changed with the movement, respectively, the respective instant placement position of the reciprocating yarn guide for conical, frictionally driven cross spools whereby, for driving the spool bodies, a plurality of rollers distributed axially along the spool length are employed which are driven synchronously and in sequence with the movement of the reciprocating yarn guide in order to wind the yarn with a substantially constant speed. The rollers which are axially arranged along the active length of the friction roller are then driven by a friction drive element coupled to the reciprocating yarn guide and accordingly moving in the longitudinal direction of the spool body in a reciprocating movement whereby the plurality of friction drive elements are driven by a single shaft for each machine, respectively machine side.

It is not disclosed whether the rollers distributed along the friction roller have spot-like drive positions by arranging thereat corresponding coatings. This would result in a discontinuous change of the winding speed. Due to the indirect drive of the rollers by the reciprocating friction drive element, it is, however, very likely that respective coatings are not provided. Accordingly, when supposing that ideal conical spools are used, torsion forces across the roller elements in the spool longitudinal direction will result. Independent of the presence or absence of such coatings, in any case, torsion forces will result because due to the final length of the friction drive element it is unavoidable that two rollers are simultaneously driven. These torsion forces will result in a high wear of the winding device and, in any case, will result in yarn damage of the respectively outer yarn layer of the spool body.

When considering the conical spools available in practice which are not ideal with regard to their conical design, slight saddle formations, i.e., oversized diameter increases at the spool flanks, may already make the basic principle questionable because the saddle formation will allow only a few rollers, in general, the two outer rollers, to drive the spool body. For a friction roller drive with a spot drive position, it is conventional to affect a modification of the placement angle resulting in a slight greater spool diameter increase at the drive point in order to thus eliminate the effect of saddle formations. This is, in principle, not possible in the suggested solution according to German Offenlegungsschrift 24 58 853 because the basic principle is to have a drive point which moves axially along the longitudinal spool direction.

The multi point support of the divided roller of the friction roller as well as the support of the continuous shaft supporting the friction drive elements which performs a translatory as well as a rotatory movement is complicated and thus cost-intensive. The suggested solution has many problems in regard to its operating principle.

It is therefore an object of the present invention to provide a method and a device with which in a simple manner problems for winding yarns onto a conical spool body, to which yarn is supplied with a constant speed or which supplies yarn at a constant speed, can be solved. The yarn winding action should be performed so as to be gentle to the yarn, i.e., torsion forces and yarn tension peaks are to prevented. The textile-technological properties, for example, the twist in the yarn or the twisted yarn should remain constant during the entire spool travel and especially independent of the placement position. Furthermore, the conventionally required mechanical yarn storage devices should be eliminated.

SUMMARY OF THE INVENTION

As a solution to this object it is inventively suggested to drive the spool body or the friction roller driving the spool body by an individual motor, having an rpm that is computer-controlled by a computing and control unit as a function of the respective placement position of the reciprocating yarn guide and of the spool body diameter such that at the respective instant winding location a constant circumferential speed of the spool body over the entire winding process is attained. For a conventionally constant speed of the reciprocating yarn guide, a constant winding speed will result for a constant circumferential speed as a vector addition of both speed magnitudes.

For this purpose, the computing and control unit must know the geometry of the empty spool of the spool body, which can be described, for example, by the stroke length, conical design of the spool, and the spool body diameter. In one constructive embodiment in which a friction roller drives the spool body, it is further required to define the position of the drive point within the stroke movement. Furthermore, the computing and control unit must know the actual placement position of the reciprocating yarn guide and the actual diameter of the spool body. Taking into consideration the spool diameter is also necessary for constructive design in which the friction roller drives the spool body because the yarn during the winding process is placed in parallel layers onto the mantle surface whereby, for a growing spool diameter, the circumferential ratio of the spool body of the greater to the smaller spool diameter is reduced.

When taking into consideration the aforementioned parameters, it is possible to change the rpm of the individual motor, driving directly the spool body or driving it by a friction roller, via the computing and control unit such that a constant winding speed can be attained during the entire winding process.

For such an embodiment of the drive of the spool body the crossing angle during the entire winding process remains constant. The resulting yarn placement onto the spool body deviates from the current yarn placement on conical spool bodies in which a constant supply speed is made possible by using a yarn storage device, for example, a pitching lever or take up device. The overlap of the movement laws of the spool body and of the yarn storage results in a constant yarn speed of the entire system of spool body and storage device. Independent thereof, the yarn placement onto the conical spool body is characterized by the spool body geometry and is thus characterized by a decreasing circumferential speed of the spool body in the direction of the spool flank with the smaller spool body diameter. This causes, for conventionally constant speed of the reciprocating yarn guide, an increase of the crossing angle in the direction of the spool flank with the smaller spool body diameter. Within one yarn or thread layer the yarn placement onto the spool body is thus performed in the shape of an Archimedes spiral because the ratio of the transverse reciprocating speed and the winding speed of the axle of the spool body is constant. In order to be able to take into consideration the winding laws for conventional conical spools, in a further embodiment of the invention it is suggested to employ, in addition to the individual motor drive of the spool body, also a motor or individual motor drive for the reciprocating yarn guide. The two drive units can then be controlled such that the resulting winding speed is constant and that a constant as well as a variable crossing angle is made possible by the stroke movement.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1–4.

Figure 1:
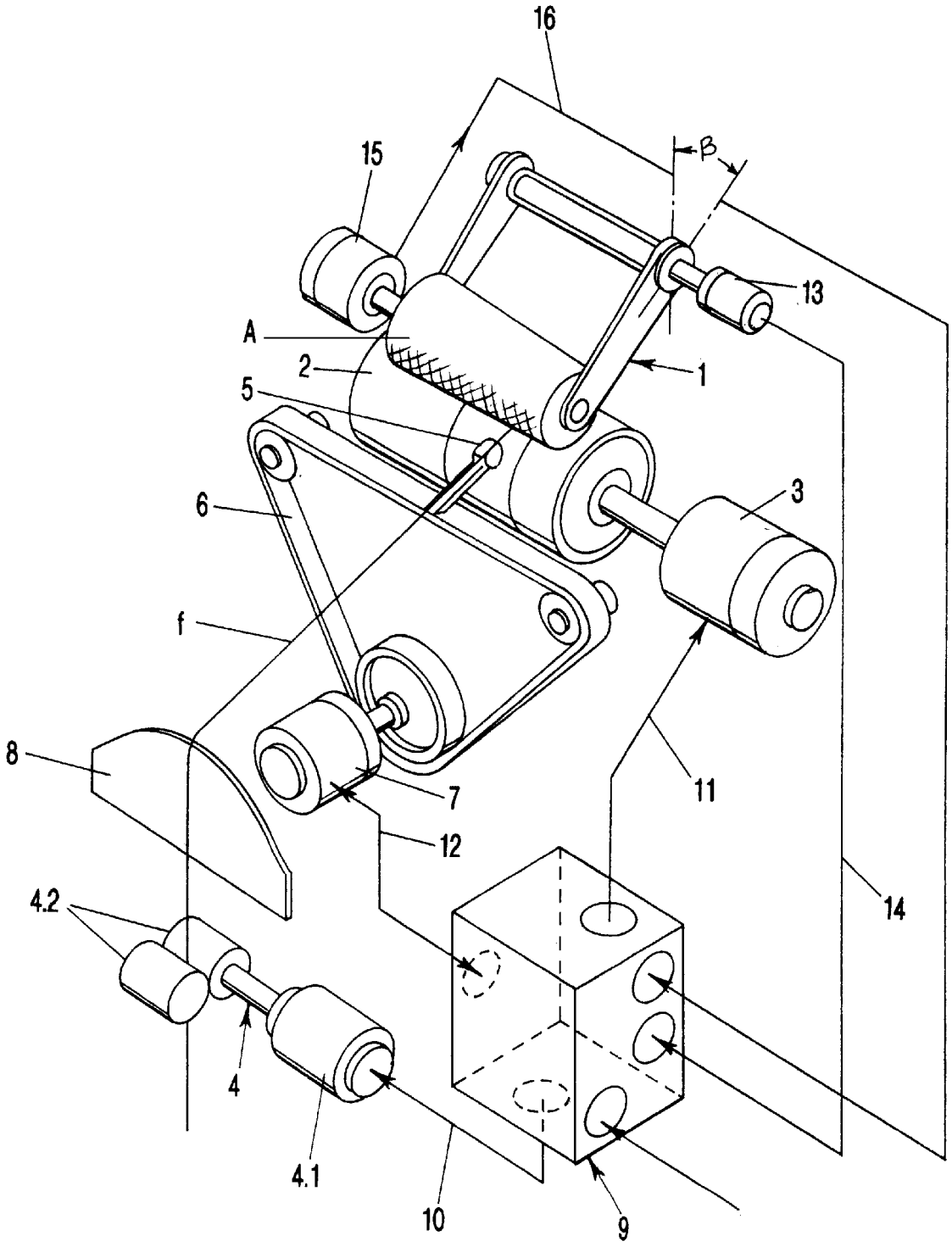
FIG. 1 shows in a schematic representation a suitable winding device for performing the inventive method, comprising a reciprocating yarn guide driven by an individual motor whereby the individual spool bodies are driven by a friction roller that is driven by a single motor.

FIG. 1 shows a winding device with a pivotably supported support frame 1 for supporting a conical spool body A. The spool body A is driven by a friction drive roller 2 which is driven in turn, by an individual motor 3 driving this friction drive roller directly.

The yarn f which is supplied by a conventional supply device 4 with constant supply speed is placed onto the rotating spool body A by a reciprocating yarn guide 5 moving back and forth across the length of the spool body A. The reciprocating yarn guide is preferably driven by a drive belt 6 that is driven alternatingly in one and in the other direction by a motor 7 which is preferably a step motor. Between the supply device 4 and the reciprocating yarn guide 5 a yarn deflecting element 8 is arranged.

A computing and control unit 9 serves to control and coordinate the individual drive units 3, 4, and 7. The supply device motor 4.1 driving the two supply rollers is controlled by the main power line 10 by the computing and control device 9 and is driven with a certain rpm in order to effect a predetermined constant yarn supply speed. The motor 7 driving the reciprocating yarn guide 2 is also driven via lines of the wiring harness 12 by the computing and control unit 9 with a certain rpm and different rotational directions in order to effect a predetermined placement speed and position.

In order to achieve that the yarn f is wound with substantially constant winding speed and substantially constant yarn tension onto the conical spool body A, it is necessary that it is driven as a function of the placement position of the reciprocating yarn guide 5 and as a function of the diameter of the spool body at the drive position with different rpm.

The placement position of the reciprocating yarn guide 5 is supplied by the computing and control unit 9 via further lines of the wiring harness 12, for example, as signals of a position sensor which is not represented in detail and which is integrated into the motor. The position sensor may be an incremental or an absolute position sensor. In a preferred embodiment of the motor 7 as a step motor, such a position sensor is not necessary because the placement position of the reciprocating yarn guide 5 of the control is directly known, after having been positioned at a reference position, by the resulting positioning steps.

For detecting the diameter of the spool body A in the area of the pivot axis of the spool support frame 1 a sensor 13 indicated in dashed lines in FIG. 1 is provided which detects the angular position data of the spool support frame 1 during winding.

As a sensor a potentiometer may be used whereby the initial voltage is proportional to the angular position $\beta$. The signal that is proportional to the position $\beta$ is supplied by lines 14 to the computing and control unit 9 which calculates the corresponding diameter based on the geometric movement functions of the spool support frame 1 known to the control unit.

Alternatively, for detecting the diameter of the spool body A according to FIG. 1 in the area of the spool support frame 1 a sensor 15, not represented in detail, can be flanged to the sleeve plate whereby the sleeve plate can be detected in force and form-locking arrangement with the spool body A. As a sensor, a single track optical rpm sensor or a Hall sensor in combination with a magnetic pole wheel can be employed whereby the initial frequency is proportional to the rpm of the spool body A. The signal that is proportional to the rpm is supplied by a line 16 to the computing and control unit 9 which calculates the corresponding diameter based on the rpm ratio of friction roller and spool body A for a known substantially constant drive point of the spool body.

The change of the rpm of the drive motor 3 driving the frictional roller 2 required for obtaining a uniform winding speed is carried out by the computing and control unit 9 via line 11 as a function of the aforementioned parameters.

Figure 2:
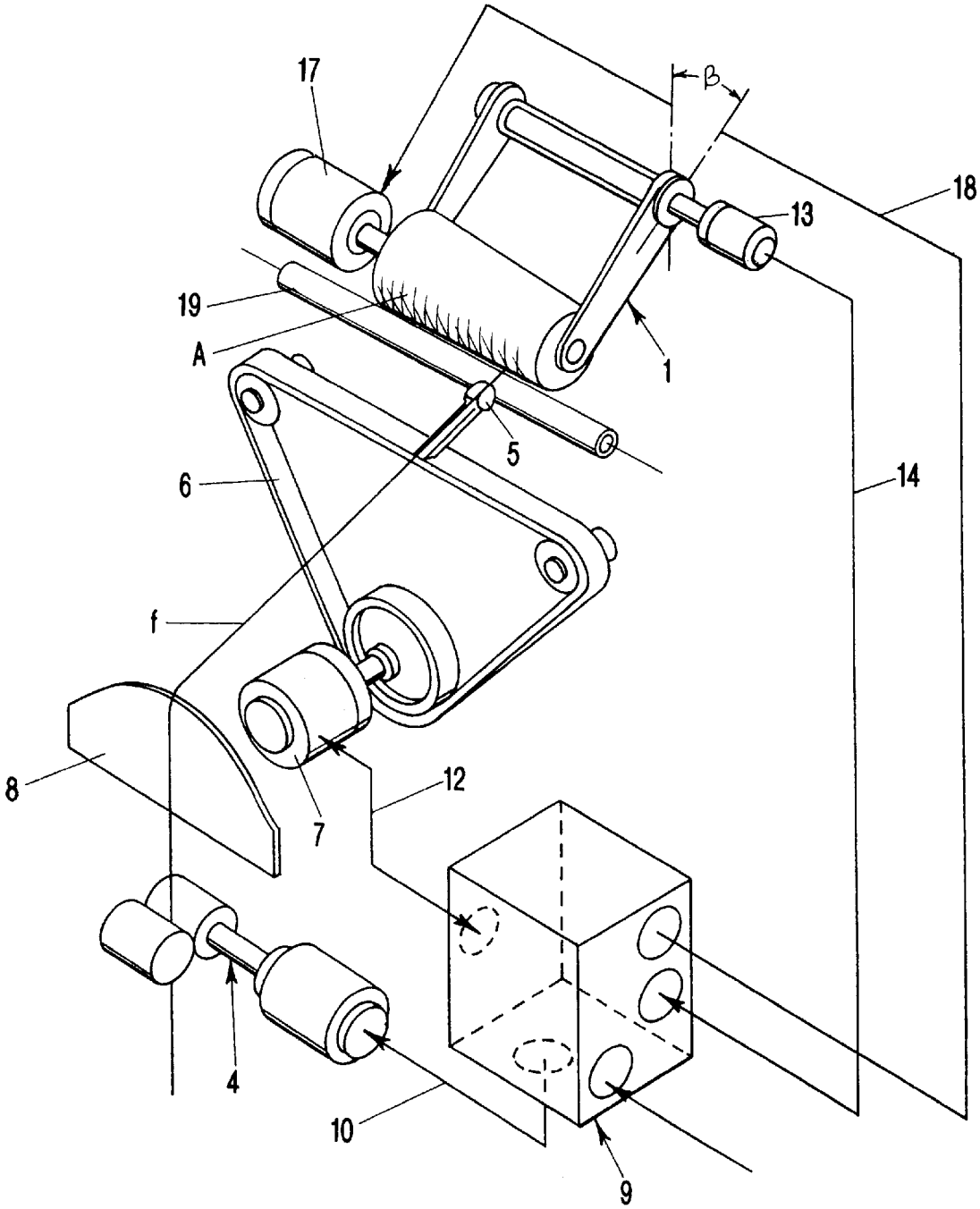
FIG. 2 shows substantially an arrangement according to FIG. 1 whereby the individual spool bodies are directly rotated by a correlated single motor.

The embodiment according to FIG. 2 differs from the embodiment according to FIG. 1 in that the drive action of the spool body A is not carried out by a friction drive roller but directly by an individual motor 17 correlated with individual spool body A. The spool body A is supported on a freely rotating support roller 19.

In this case the adjustment of the rpm of the motor 17 is carried out via lines 18 in a two fold manner.

The direct drive of the spool body A requires that with increasing spool body diameter the nominal rpm of the motor 17 be reduced. The nominal rpm is the rpm of the motor 17 which is present for a freely selectable virtual drive point, for example, at the center of the spool body which is in the reference point of the rpm change as a function of the placement position for the computing and control unit 9. For detecting the spool body diameter, in the area of the pivot axis of the spool support frame 1 a sensor 13 is provided which detects the angular position β of the spool support frame during winding and which determines based thereon, with the aid of the method disclosed in connection with FIG. 1, the spool body diameter.

The required rpm change for compensation of the different spool diameters of the conical spool as a function of the placement position and as a function of the diameter of the spool body is then determined relative to the virtual drive point in the manner disclosed in connection with FIG. 1.

For adjusting the rpm of the motor 18 via the lines 18 the computing and control unit 9 will superimpose both parameters.

Figure 3:
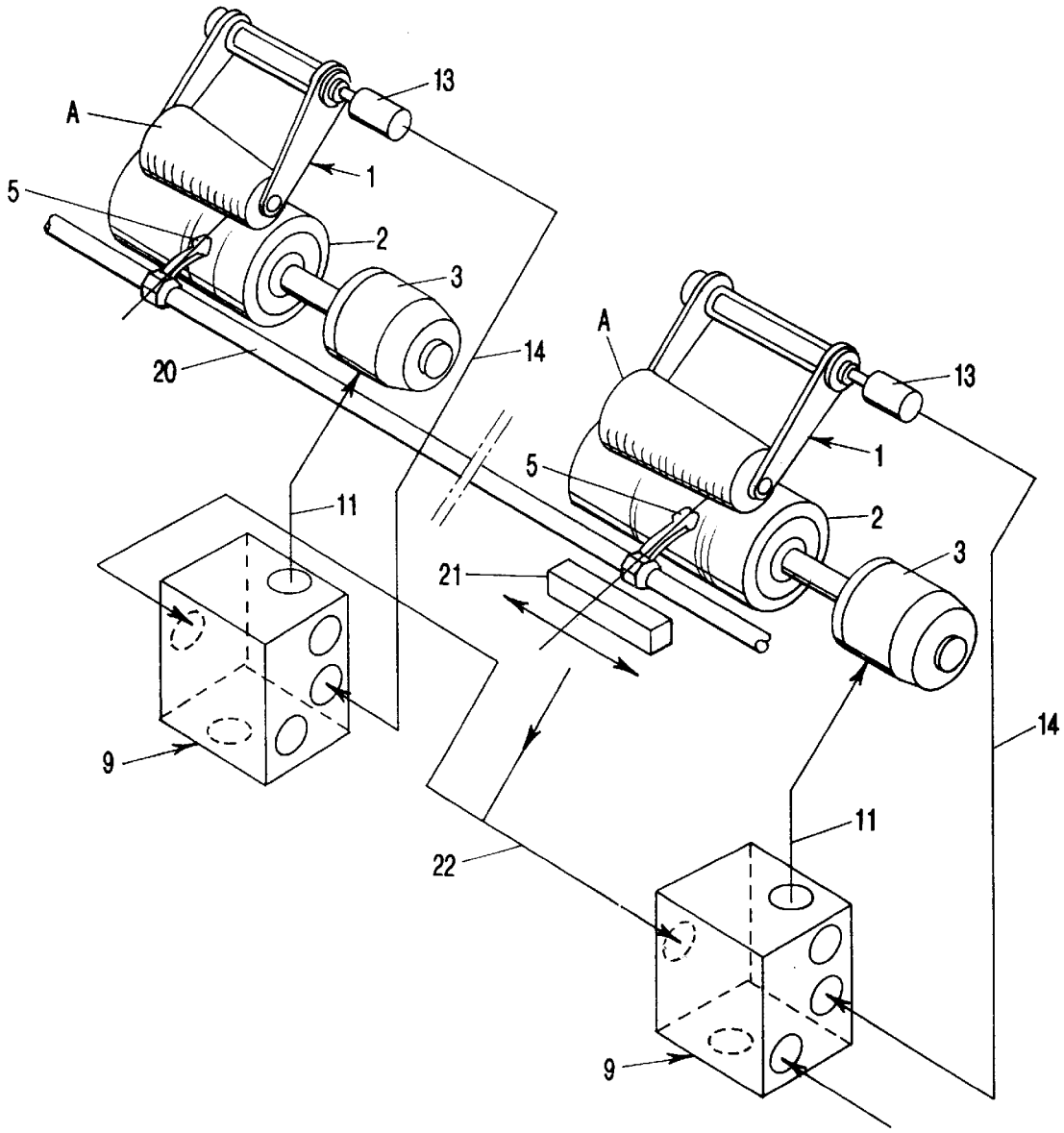
FIG. 3 shows in a schematic representation two adjacently arranged winding devices whereby the individual reciprocating yarn guides are driven by a single drive unit.

FIG. 3 shows two adjacently arranged winding devices of a machine with multiple workstations. The drive of the two spool bodies A is realized with two friction rollers 2 which are driven individually by single motors 3. Per workstation a computing and control device is provided which have supplied thereto the signals of sensors 13, required for each station for detecting the diameter of the spool body A, via lines 14 and change respectively the motors 3 via lines 11 with regard to rpm. In deviation from the system according to FIG. 1, the reciprocating yarn guides 5 correlated with the two winding devices are driven together by a guide rod 20 in an alternating manner. For such a system the position of only one of the reciprocating yarn guides 5 must be detected, preferably by a travel and position sensor 21 which is represented only schematically in FIG. 3. This position sensor supplies for all winding devices of the multi workstation machine via the main line 22 the placement position of the reciprocating yam guides to the respective computing and control unit 9 in order to adjust the rpm of the respective individual motors 3 and thus of the respective frictional drive roller 2 at the placement position of the reciprocating yarn guide 5 and to thus provide a constant winding speed.

Figure 4:
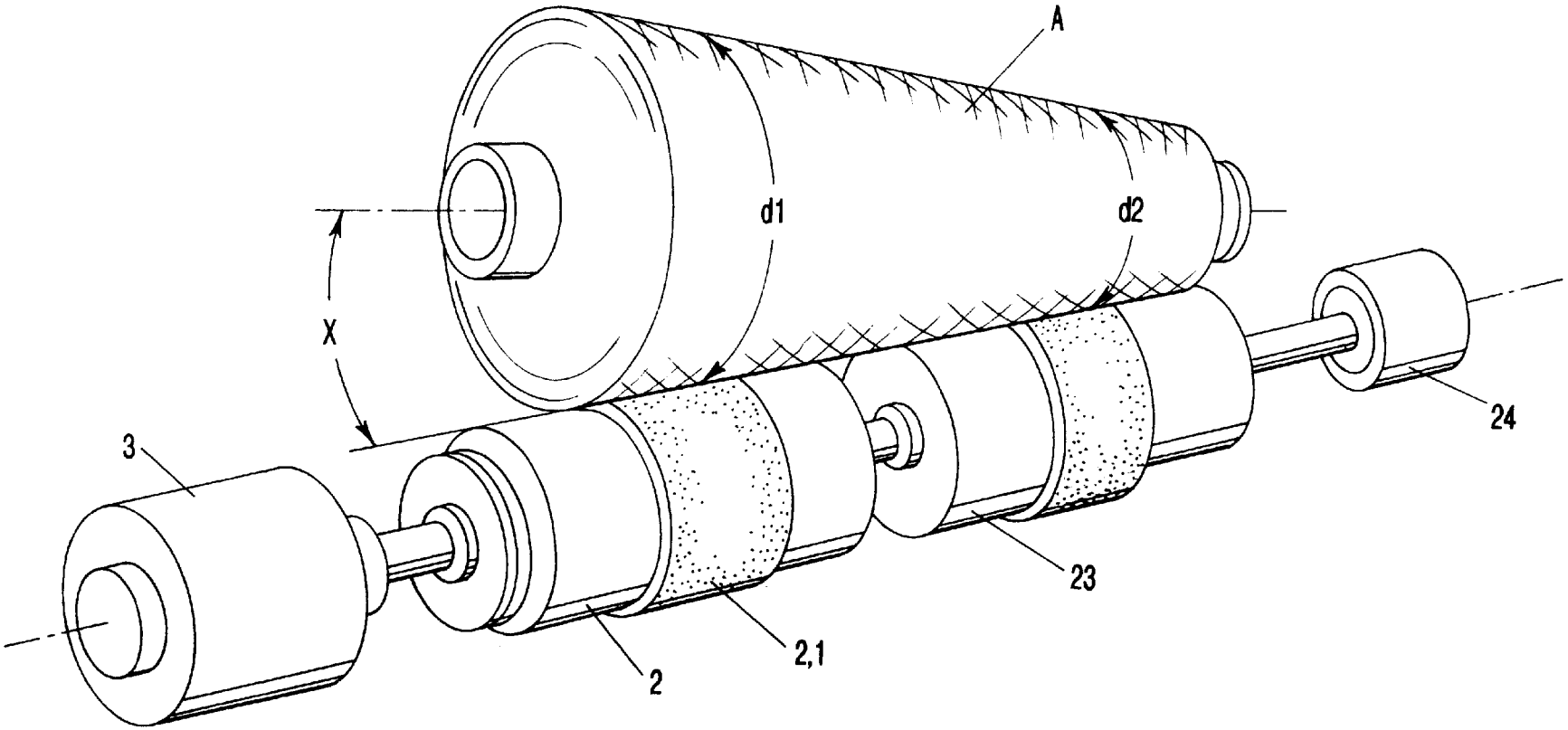
FIG. 4 shows a friction drive for a spool body with correlated sensor device for detecting the conical shape of the spool body.

In the device according to FIG. 4 the spool body A is driven by a drive roller 2 that is driven by a individual motor 3 which drive roller is provided with a friction coating 2.1 as is the case for the embodiments according to FIGS. 1 and 3.

At the outer circumference of the spool body A, a sensor roller 23 is provided which is positioned on the same axis as the friction drive roller 2. Its rpm, respectively, circumferential speed is supplied via the sensor 24 as an additional parameter into the computing and control unit 9 not represented in FIG. 4. With such a system, the circumferential speed of the spool body A can be detected at two portions distributed and spaced apart across the length of the spool body and their ratio can be determined so that the computation of the actually present conical shape, respectively, of the cone angle of the spool body A can be determined by the computing and control unit. Since the required rpm change that depends on the placement position is a function of the conical shape, the precise determination of the conical shape is important in order to provide for a suitable rpm correction by the computer and control unit, especially at the small diameter of the spool body since here for deviations between the actual conical shape and the nominal conical parameters substantial deviations of the winding speed as a function of the placement position are possible.

With a device according to FIG. 4 the computing and control device thus determines automatically the actual conical shape so that even minimal changes of the conical shape of the spool body can be taken into consideration during winding.

The specification incorporates by reference the disclosure of European priority document 98 102 591.9 of Feb. 14, 1998.

The present invention is, of course, in no way restricted to the specific disclosure of the specification and drawings, but also encompasses any modifications within the scope of the appended claims.

What is claimed is:

1. A method for winding yarn onto a conical spool sleeve, the method comprising the steps of:

driving the conical spool sleeve about a longitudinal axis by a first drive unit;

determining a geometry of the conical spool sleeve;

guiding yarn onto the conical spool sleeve by a reciprocating yarn guide thereby winding the yarn onto the conical spool sleeve to form a spool body;

providing a constant yarn winding speed along the length of the spool body during the entire yarn winding process by adjusting the revolutions per minute (rpm) of the spool body synchronously with a movement of said reciprocating yarn guide;

controlling the revolutions per minute (rpm) of said first drive unit by a computing and control unit by entering information of the geometry of the conical spool sleeve, an actual placement position of the reciprocating yarn guide and an actual diameter of the spool body at the actual placement position into the computing and control unit; and changing a translatory speed of the reciprocating yarn guide based on the actual placement position such that the translatory speed comprises a maximum speed at a small diameter end of the spool body and a minimum speed at a large diameter end of the spool body.

2. A method according to claim 1, further comprising the steps of:

driving the reciprocating yarn guide by a second drive unit; and sending switching impulses of the second drive unit as parameters of the actual placement position of the reciprocating yarn guide to the computing and control unit for controlling the rpm of the first drive unit.

3. A method according to claim 1, wherein in the step of driving the first drive unit comprises a friction roller and wherein the friction roller is rotatingly driven by the drive unit and frictionally drives, in turn, the spool body by engaging a circumferential surface of the spool body.

4. A method according to claim 1, wherein in the step of driving the spool body is directly driven by the first drive unit, the method further comprising the step of measuring diameter values of the growing diameter of the spool body during the winding process and sending the measured diameter values to the computing and control unit as entered information for controlling the rpm of the first drive unit.

5. A method according to claim 1, further comprising the steps of:

determining a first circumferential speed and a second circumferential speed of the spool body at two spaced apart sections of a length of the spool body;

calculating a ratio of the first and second circumferential speeds; and entering the calculated ratio as an additional input into the computing and control unit for controlling the rpm of the first drive unit.

6. A method according to claim 1 further comprising a plurality of reciprocating yarn guides, each serving one spool body and a guide rod, the method further comprising the steps of:

connecting the plurality of reciprocating yarn guides to the guide rod and driving the guide rod by a second drive unit; and detecting by a position sensor the actual placement position of at least one of the reciprocating yarn guides and supplying a corresponding position signal as an input to the computing and control unit for controlling the rpm of the first drive unit.

7. An apparatus for winding yarn onto a conical spool sleeve, said device comprising:

a pivotable spool support frame for supporting said conical spool sleeve;

a first drive unit for driving said conical spool sleeve and thereby winding the yarn onto said conical spool sleeve to form a spool body;

a reciprocating yarn guide having a detection apparatus for detecting an actual placement position of said reciprocating yam guide along a length of said spool body to be used as a first parameter, wherein said detection apparatus comprises a second drive unit drivingly connected to said reciprocating yarn guide wherein switching pulses of said second drive unit are used to determine said actual placement position of said reciprocating yarn guide;

a sensor for detecting a changing diameter of said spool body to be used as a second parameter;

a computing and control unit in which the first and second parameters are processed to control signals supplied to said first drive unit for controlling a rpm of said first drive unit; and a means for adjusting a translatory speed of said reciprocating yarn guide based on said actual placement position such that said translatory speed comprises a maximum speed at a small diameter end of said spool body and a minimum speed at the large diameter end of said spool body.

8. The invention of claim 7, wherein said first drive unit comprises a motor and a friction roller driven by said motor and driving, in turn, said spool body.

9. The invention of claim 7, wherein said sensor for detecting a changing diameter of said spool body comprises said sensor transmiting a diameter value to said computing and control unit and wherein based on said changing diameter, the rpm of said first drive unit is adjusted.

10. The invention of claim 7, further comprising a guide rod for a plurality of reciprocating yarn guides, each yarn guide serving one spool body, wherein said plurality of reciprocating yarn guides are connected to said guide rod and wherein said guide rod is driven by a second drive unit, further comprising a position sensor for detecting said actual placement position of at least one of said plurality of reciprocating yarn guides.

11. The invention of claim 7, further comprising a means for determining a first circumferential speed and a second circumferential speed of said spool body at two spaced apart sections of a length of said spool body and a means for calculating a ratio of said first and second circumferential speeds, wherein a change of said ratio is employed by said computing and control unit as an additional control parameter for controlling said rpm of said first drive unit.

* * * * *